US007137376B2

(12) United States Patent
Ito

(10) Patent No.: US 7,137,376 B2
(45) Date of Patent: Nov. 21, 2006

(54) VISCOIDAL FLUID REMOVING ARRANGEMENT FOR ENGINE

(75) Inventor: Kazumasa Ito, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 235 days.

(21) Appl. No.: 10/341,188

(22) Filed: Jan. 13, 2003

(65) Prior Publication Data

US 2005/0268878 A1 Dec. 8, 2005

(30) Foreign Application Priority Data

Jan. 11, 2002 (JP) ..... 2002-004340

(51) Int. Cl.
*F01M 1/02* (2006.01)
*F02B 61/04* (2006.01)
*F02B 75/22* (2006.01)

(52) U.S. Cl. ..... 123/196 R; 123/198 R

(58) Field of Classification Search ..... 123/195 R, 123/198 R, 196 R
See application file for complete search history.

(56) References Cited

U.S. PATENT DOCUMENTS 5,558,549 A 9/1996 Nakase et al.
5,839,930 A 11/1998 Nanami et al.
5,899,779 A 5/1999 Hattori
5,951,343 A 9/1999 Nanami et al.
6,015,320 A 1/2000 Nanami
6,454,622 B1 9/2002 Mashiko et al.

FOREIGN PATENT DOCUMENTS

JP 10205318 A * 8/1998

* cited by examiner

*Primary Examiner*—Noah P. Kamen
(74) *Attorney, Agent, or Firm*—Knobbe, Martens, Olson & Bear, LLP

(57) ABSTRACT

An engine has a flywheel magneto mounted on one end of a crankshaft. The flywheel magneto rotates together with the crankshaft. A cover member is coupled with an engine body and defines a space together with the engine body. The flywheel magneto is enclosed within the space. The space contains lubricant and/or lubricant mist that can adhere onto the flywheel magneto. The cover member defines first ribs that extend toward the flywheel magneto and that are closed spaced from the flywheel magneto so as to remove lubricant adhered on the flywheel magneto when the flywheel magneto rotates. The cover member also defines second ribs extending toward the flywheel magneto and an lubricant collecting recess formed on an inner surface of the cover member. The second ribs also remove lubricant adhered on the flywheel magneto and guide the lubricant toward the lubricant collecting recess when the flywheel magneto rotates.

31 Claims, 5 Drawing Sheets

VISCOIDAL FLUID REMOVING ARRANGEMENT FOR ENGINE

PRIORITY INFORMATION

This application is based on and claims priority to Japanese Patent Application No 2002-004340, filed on Jan. 11, 2002, the entire contents of which is hereby expressly incorporated by reference.

BACKGROUND OF THE INVENTION

1. Field of the Invention

The present invention relates generally to a viscoidal fluid (e.g., lubricant) removing arrangement for an engine, and more particularly to a viscoidal fluid removing arrangement that removes fluid adhered to an auxiliary device or rotating component of an engine.

2. Description of Related Art

Relatively small watercrafts such as, for example, personal watercrafts have become very popular in recent years. This type of watercraft is quite sporting in nature and carries one or more riders. A hull of the watercraft typically defines a rider's area above an engine compartment. An internal combustion engine powers a jet pump assembly that propels the watercraft by discharging water rearwardly. The engine lies within the engine compartment in front of a tunnel, which is formed on an underside of the hull. A principal portion of the jet pump assembly is placed within the tunnel and includes an impeller that is driven by the engine to propel the watercraft.

The engine can incorporate a flywheel assembly at one end of a crankshaft to stabilize rotation of a crankshaft of the engine. Typically, the flywheel assembly for the personal watercraft forms a flywheel magneto that generates electric power used for engine operation and for other purposes. In one arrangement, the flywheel assembly is disposed in a space defined in front of a crankcase chamber of the engine. A cover member, together with a body of the engine, completes the space. The space normally communicates with the crankcase chamber through one or more openings.

Typically, the crankshaft is lubricated by oil lubricant and part of the oil can move into the space through the openings as either liquid oil or oil mist. In addition, blow-by gases that have passed from the combustion chamber to the crankcase chamber also accumulate within the crankcase chamber and can move into the space through the openings with the oil mist. The lubricant oil and oil mist are useful for lubricating and cooling the flywheel assembly. However, the lubricant oil, the oil mist and the blow-by gases can adhere to the flywheel assembly as viscoidal fluid and can create rotational resistance that inhibits the flywheel assembly from rotating smoothly.

SUMMARY OF THE INVENTION

An aspect of the present invention involves the recognition that viscoidal fluids (e.g., liquid lubricant, lubricant mist, and blow-by-gases) can adhere to the flywheel assembly and can create rotational resistance that inhibits the flywheel assembly from rotating smoothly. A further aspect of the present invention thus provides a viscoidal fluid removing arrangement for an engine that effectively removes viscoidal fluid adhered onto an auxiliary device or rotating component of the engine.

In one preferred mode, an internal combustion engine comprises an engine body. A crankshaft is journaled on the engine body. A flywheel assembly is mounted on one end of the crankshaft. The flywheel assembly rotates together with the crankshaft. An enclosure member is coupled with the engine body and defines a space together with the engine body. The flywheel assembly is enclosed within the space. The space contains oil or oil mist that is capable to adhere onto the flywheel assembly. The enclosure member defines a projection extending toward the flywheel assembly. The projection scratches away the oil adhered on the flywheel assembly when the flywheel assembly rotates.

In accordance with another aspect of the present invention, an internal an engine body and a rotatable member that rotates relative to the engine body. An auxiliary device is coupled to the rotatable member so as to rotate with the rotatable member. An enclosure member at least partially covers the auxiliary device with the auxiliary device being enclosed within a space that is defined at least in part by the enclosure member. The space contains viscoidal fluid (e.g., lubricant, lubricant mist, and/or blow-by gases) that generally adheres onto the auxiliary device. The enclosure member includes a projection that extends toward the auxiliary device. The projection is spaced closely to the auxiliary device so as to remove at least a portion of the viscoidal fluid adhered on the auxiliary device when the auxiliary device rotates.

An additional aspect of the present invention involves an internal combustion engine comprises an engine body and a rotatable member that rotates relative to the engine body. An auxiliary device is coupled to the rotatable member so as to rotate with the rotatable member. An enclosure member at least partially covers the auxiliary device with the auxiliary device being enclosed within a space that is defined at least in part by the enclosure member. The space contains viscoidal fluid that generally adheres onto the auxiliary device. The enclosure member includes a projection extending toward the auxiliary device. A fluid collecting recess is generally formed on an inner surface of the enclosure member the projection removing at least a portion of the viscoidal fluid adhered on the auxiliary device and guiding the viscoidal fluid toward the fluid collecting recess when the auxiliary device rotates.

BRIEF DESCRIPTION OF THE DRAWINGS

These and other features, aspects and advantages of the present invention will now be described with reference to the drawings of preferred embodiments, which are intended to illustrate and not to limit the invention. The drawings comprise five figures.

DETAILED DESCRIPTION OF PREFERRED EMBODIMENTS

Figure 1:
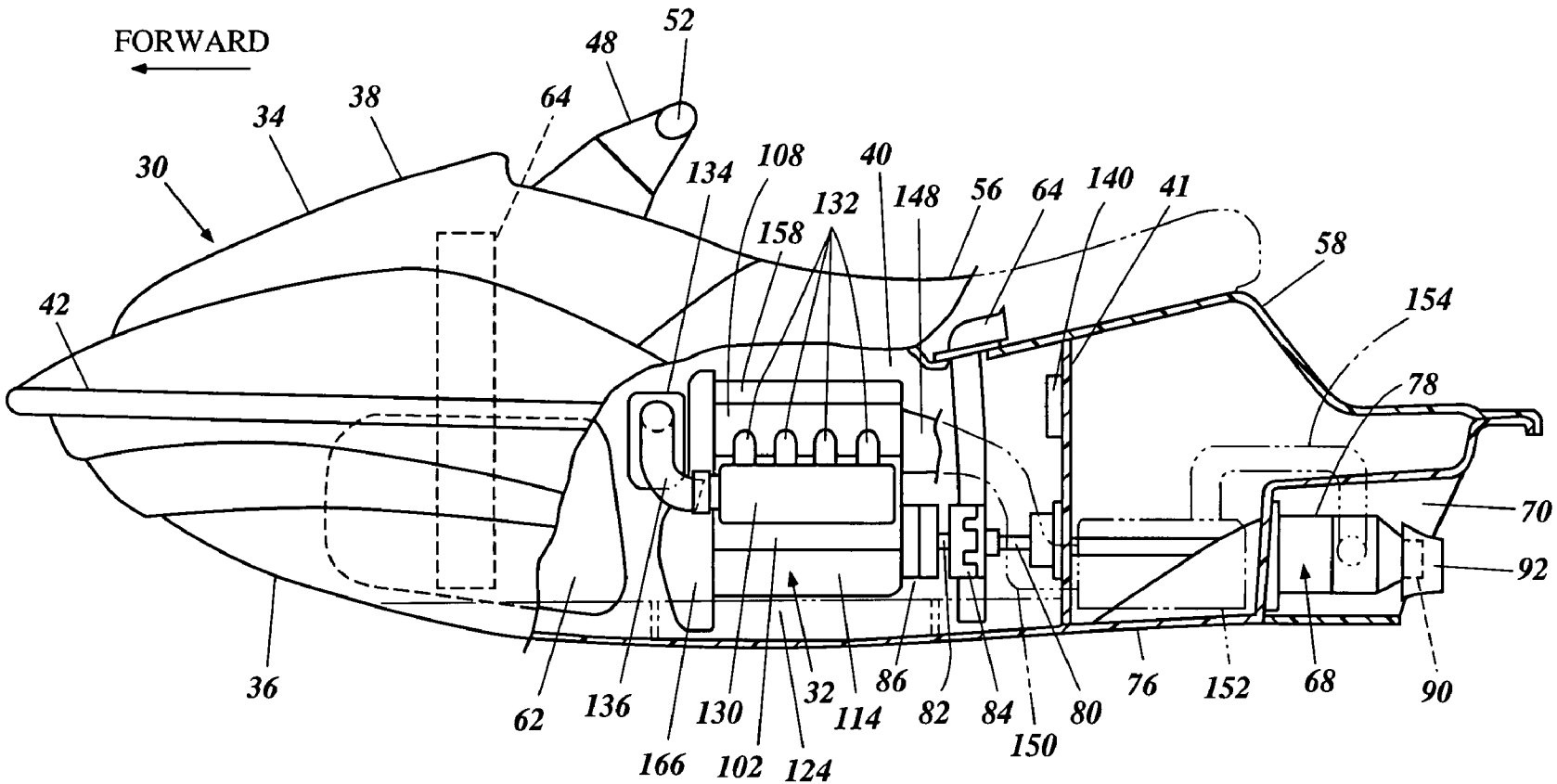
FIG. 1 is a side elevational view of a personal watercraft that incorporates an engine configured in accordance with a preferred embodiment of the present invention.
Figure 2:
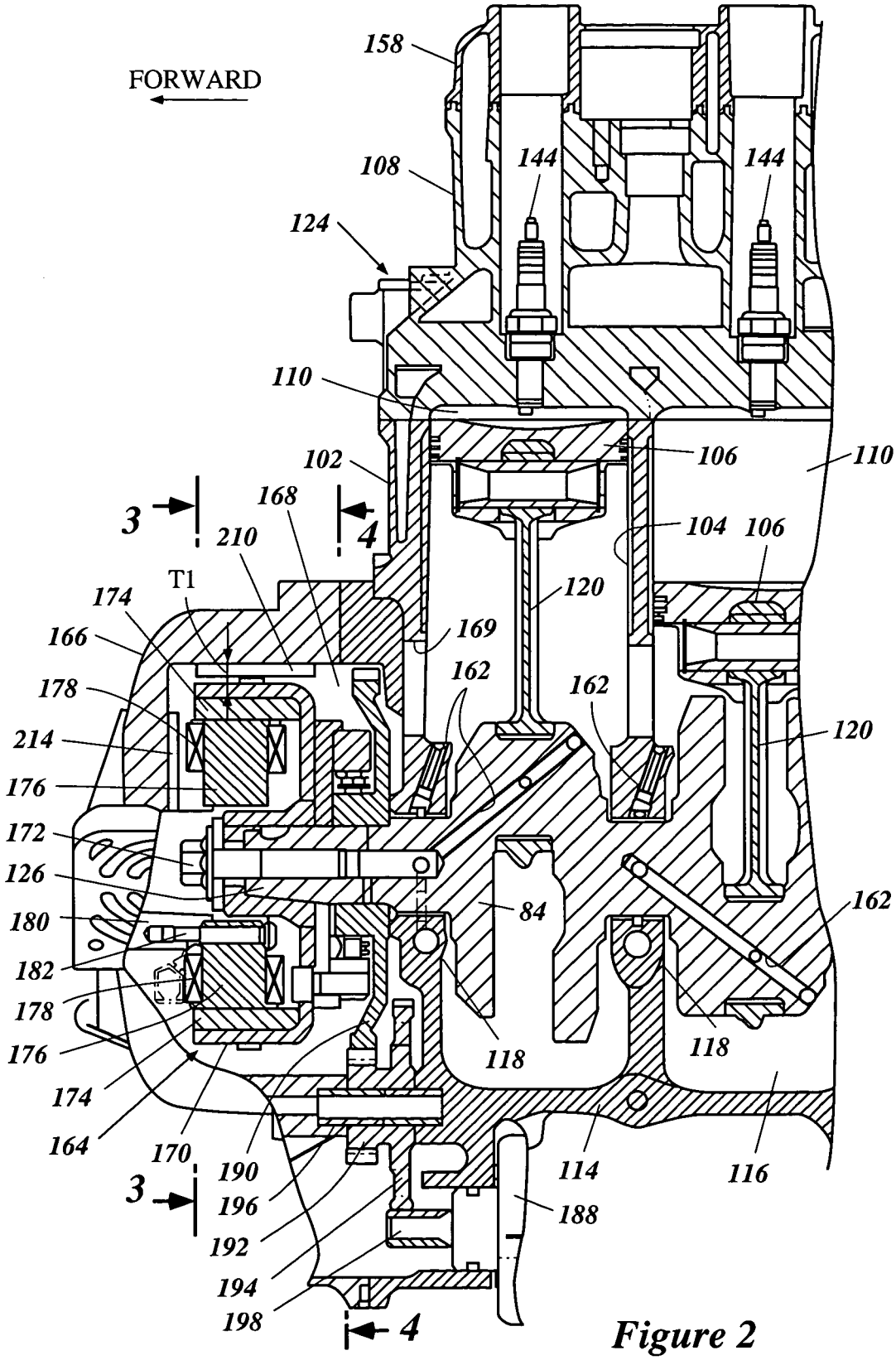
FIG. 2 is a partial cross-sectional view of the engine.

With reference to FIGS. 1 and 2, an overall construction of a personal watercraft 30 and an internal combustion engine 32 will be described. The engine 32 is configured in accordance with a preferred embodiment of the present invention and is incorporated in the watercraft 30. The engine 32 is described in the context of a marine engine for a personal watercraft. The engine 32, however, can be incorporated in other types of watercraft such as jet boats and other motor boats including leisure boats and fishing boats. In some arrangements, the engine can be used for land vehicles or work machines such as lawnmowers. Applicable watercrafts, land vehicles or work machines will become apparent to those of ordinary skill in the art.

The personal watercraft 30 includes a hull 34 generally formed by a lower hull section 36 and an upper hull section or deck 38. Both the hull sections 36, 38 are made of, for example, a molded fiberglass reinforced resin or a sheet molding compound. The lower hull section 36 and the upper hull section 38 are coupled together to define an internal cavity which wholly or partially defines an engine compartment 40. The hull 36 houses the engine 32 in the engine compartment 40. A bulkhead 41 preferably isolates the engine compartment 40 from a rear portion of the hull 34. An intersection of the hull sections 36, 38 is defined in part along an outer surface gunwale or bulwark 42.

The hull 34 defines a center plane that extends generally vertically from bow to stern with the watercraft 30 floating in a normal upright position. The lower hull section 36 is designed such that the watercraft 30 planes or rides on a minimum surface area at the aft end of the lower hull 38 in order to optimize the speed and handling of the watercraft 30 when up on plane. For this purpose, the lower hull section 36 generally has a V-shaped configuration formed by a pair of inclined sections that extend outwardly from the center plane of the hull 34 to the hull's side walls at a dead rise angle.

A steering mast 48 extends generally upwardly from a bow area toward the top of the upper hull section 38 to support a handlebar 52. The handlebar 52 is provided primarily for a rider to control the steering mast 48 so that a thrust direction of the watercraft 30 is properly changed. The handlebar 52 also carries control devices such as, for example, a throttle lever for operating throttle valves of the engine 32.

In the illustrated embodiment, a seat 56 extends fore to aft along the center plane at a location behind the steering mast 48. The seat 56 has generally a saddle shape so that the rider can straddle the seat 56. The illustrated upper hull section 38 defines a seat pedestal 58 and the seat 56 is detachably placed or hingedly affixed to the seat pedestal 58. Foot areas are defined on both sides of the seat 56 and at the top surface of the upper hull section 38. An access opening is defined on the top surface of the seat pedestal 58 under the seat 56. The rider thus can access the engine compartment 40 through the access opening.

A fuel tank 62 is placed in the internal cavity under the upper hull section 38 and preferably in front of the engine 32. The fuel tank 62 is coupled with a fuel inlet port positioned at a top surface of the upper hull section 38 through a filler duct. A closure cap closes the fuel inlet port.

Air ducts or ventilation ducts 64 are provided at appropriate locations within the upper hull section 38 so that the ambient air can enter the internal cavity through the ducts 64. In the illustrated arrangement, the air ducts 64 are positioned in front of the engine 32 and to the rear of the engine 32. Except for the air ducts 64, the engine compartment 40 is substantially sealed so as to protect the engine 32 and engine related components from water.

A jet pump assembly 68 propels the watercraft 30. The jet pump assembly 68 is preferably mounted in a tunnel or pump recess 70 formed on the underside of the lower hull section 58. A portion of the tunnel 70 extends forwardly of the jet pump assembly 68 and curves downwardly to a downward facing inlet port 76 to opens toward the body of the body of the water. At least a portion of the tunnel 70 and at least a portion of the port 76 preferably are defined at least in part by the lower hull section 36; however, the in some watercraft, the hull need not form a portion of either the tunnel or the inlet port. The forward portion of the tunnel 70 and the jet pump assembly 68 together define a jet water passage 78.

The jet pump assembly 68 journals an impeller (not shown) in the jet water passage 78, and more particularly, in a housing of the jet pump assembly 68. An impeller shaft 80 extends forwardly from the impeller through the bulkhead 41 and preferably is coupled to an output shaft 82 that extends from the engine 32 by a coupling device 84. In the illustrated embodiment, the output shaft 82 is coupled with a crankshaft 84 (FIG. 2) of the engine 32, which will be described in greater detail below, through a transmission mechanism 86 including a speed reduction unit. The output shaft, however, can be directly coupled to the crankshaft or, in the alternative, the crankshaft can be directly coupled to the coupling device.

The rear end of the pump assembly 68 defines a discharge nozzle 90 that is an outlet port of the jet water passage 78. A deflector or steering nozzle 92 is affixed to the discharge nozzle 90 such that the deflector 92 can pivot about a vertically extending steering axis. A cable connects the deflector 92 with the steering mast 48 so that the rider can rotate the deflector 92 to steer the watercraft.

When the output shaft 82 drives the impeller shaft and the impeller thus rotates, water is drawn from the surrounding body of water through the inlet opening 76. The pressure generated in the pump assembly 68 by the impeller produces a jet of water that is discharged through the discharge nozzle 90 and the deflector 92. The water jet thus produces thrust to propel the watercraft 30.

With continued reference to FIGS. 1 and 2, the engine 32 preferably operates on a four-cycle combustion principle. The engine 32 comprises a cylinder block 102 that preferably defines four inclined cylinder bores 104 arranged from fore to aft along the center plane. The engine 32 thus is a L4 (in-line four cylinder) type engine. The illustrated four-cycle engine, however, merely exemplifies one type of engine. Engines having other number of cylinders including a single cylinder, and having other cylinder arrangements (e.g., V and W type) and other cylinder orientations (e.g., upright cylinder banks) are all practicable.

Each cylinder bore 104 has a center axis that is inclined relative to the center plane so that the overall height of the engine 32 is shorter. All the center axes of the cylinder bores 104 preferably slant at the same angle relative to the center plane.

Moveable members, such as, for example, pistons 106, move relative to the cylinder block 102 and specifically within the cylinder bores 104. A cylinder head member 108 is affixed to an upper end portion of the cylinder block 102 to close respective upper ends of the cylinder bores 104 to define combustion chambers 110 together with the cylinder bores 104 and the pistons 106.

A crankcase member 114 is affixed to a lower end portion of the cylinder block 102 to close respective lower ends of the cylinder bores 104 and to define a crankcase chamber 116 with the cylinder block 102.

The illustrated engine 32 has at least two rotatable members. The crankshaft 84 is one of the rotatable members and is journaled for rotation at bearing sections 118 formed on the cylinder block 102 and the crankcase member 114. In other words, the illustrated crankshaft 84 is rotatably interposed between the cylinder block 102 and the crankcase member 114. Alternatively, the bearing sections 118 can comprise the crankcase member 114 and bearing caps except for forward-most and rear-most bearing sections 118. Otherwise, the crankcase member 114 can be divided into upper and lower sections and both the upper and lower sections can form the bearing sections 118. Connecting rods 120 couple the crankshaft 84 with the pistons 106 so that the crankshaft 84 rotates with the reciprocal movement of the pistons 106.

The cylinder block 102, the cylinder head member 108 and the crankcase member 114 together define an engine body 124. The engine body 124 preferably is made of aluminum based alloy. In the illustrated arrangement, the engine body 124 is oriented in the engine compartment 40 to position the crankshaft 84 generally parallel to the center plane and to extend generally in the longitudinal direction (i.e., in a fore to aft direction). A forward end 126 of the crankshaft 84 extends beyond the engine body 124, i.e., beyond the forward-most bearing section 118. Other orientations of the engine body 124, of course, also are possible (e.g., with a transversely or vertically oriented crankshaft).

Engine mounts (not shown) extend from two or more sides of the engine body 124. The engine mounts preferably include resilient portions made of flexible material, for example, a rubber material. The engine body 124 is mounted on the lower hull section 36, specifically, a hull liner, by the engine mounts so that vibrations from the engine 32 are inhibited from transferring to the hull section 36.

The engine 32 preferably comprises an air intake system to deliver air to the combustion chambers 110. The illustrated air intake system includes four inner intake passages defined in the cylinder head member 108. The inner intake passages communicate with the associated combustion chambers 110 through one or more intake ports. Intake valves are provided at the intake ports to selectively connect and disconnect the inner intake passages with the combustion chambers 110.

With reference to FIG. 1, the inner intake passages also preferably communicate with a single plenum chamber defined by a plenum chamber unit 130 through outer intake passages defined by four intake conduits 132. In the illustrated arrangement, the plenum chamber unit 130 is disposed at a side surface of the engine body 124 on the port side and smoothes the air to the combustion chambers 110. An intake silencer 134 preferably is placed in front of the engine body 124 for quieting the intake air. An intake air duct 136 couples the silencer 134 to the plenum chamber unit 130. The air silencer 134 defines at least one air inlet through which ambient air in the engine compartment 40 is drawn into the air intake system.

Each outer intake passage 132 preferably defines a throttle body in which a throttle valve is journaled for pivotal movement; however, the engine can use other types of intake air control devices (e.g., throttle-less technology). A valve shaft links all of the throttle valves to synchronize valve movement. The pivotal movement of the valve shaft is controlled by the throttle lever on the handle bar 52 through a control cable that is connected to the valve shaft. The rider thus can control an opening degree of each throttle valve by operating the throttle lever to obtain various engine speeds. Normally, a greater opening degree of the throttle valves will produce a higher engine speed.

The engine 32 preferably comprises fuel injectors disposed at the outer intake passages 132. The fuel injectors spray fuel toward the inner intake passages for combustion in the combustion chambers 110. The fuel is supplied from the fuel tank 62 disposed within the hull 34. The fuel injection by the injectors preferably is controlled by an electronic control unit (ECU) therein. A container 140 affixed to the bulkhead 41 encloses the ECU together with other electrical components or parts.

A direct fuel injection system that sprays fuel directly into the combustion chambers can replace the indirect or intake passage oriented fuel injection system. Moreover, other charge formers such as, for example, carburetors can replace the fuel injection systems.

With reference to FIG. 2, the engine 32 preferably comprises a firing or ignition system. In the illustrated embodiment, the firing system includes four spark plugs 144, one spark plug 144 allotted to each combustion chamber 110. The spark plugs 144 are affixed to the cylinder head member 108 so that electrodes, which are defined at ends of the plugs 144, are exposed to the respective combustion chambers 110. The spark plugs 144 ignites air/fuel charges in the combustion chambers 110 at specific ignition timing under control of the ECU. The air/fuel charges thus burn and expand within the combustion chambers 110, thereby causing the corresponding piston to move toward its bottom-dead-center position (e.g., to move generally downwardly in the illustrated embodiment).

With reference to FIG. 1, the engine 32 preferably is provided with an exhaust system to route burnt charges, i.e., exhaust gases, from the combustion chambers 110 to an external location. In the illustrated arrangement, the exhaust system includes four inner exhaust passages defined within the cylinder head member 108. The inner exhaust passages communicate with the associated combustion chambers 110 through one or more exhaust ports. Exhaust valves are provided at the exhaust ports to selectively connect and disconnect the exhaust passages from the combustion chambers 110.

The exhaust system preferably comprises an exhaust manifold 148, at least one exhaust conduit 150, an exhaust silencer or waterlock device 152 and an exhaust discharge pipe 154. Those exhaust components 148, 150, 152, 154 are connected in series and together define outer exhaust passages coupled with the inner exhaust passages. The outer exhaust passages are unified into a single exhaust passage within the exhaust conduit 150. The exhaust conduit 150 can wrap around the engine body 124 to elongate itself for better exhaust effect.

The exhaust silencer 152 preferably is placed at a location generally behind and on the port side of the engine body 124. The exhaust silencer 152 is secured to the lower hull 36 or to the hull liner. The discharge pipe 154 extends from a top surface of the exhaust silencer 152 and transversely across the center plane to the starboard side. The discharge pipe 154 then extends rearwardly and opens at the tunnel 70. That is, the discharge pipe 154 communicates with the exterior of the watercraft 30. The exhaust silencer 152 has one or more expansion chambers to reduce exhaust noise and also to inhibit the water in the discharge pipe 154 from entering the exhaust conduit 150 even if the watercraft 30 capsizes.

The engine 32 preferably has a valve actuation mechanism for actuating the intake and exhaust valves. In the illustrated embodiment, the valve actuation mechanism comprises a double overhead camshaft drive including an intake camshaft and an exhaust camshaft. The intake and exhaust camshafts are additional rotatable members in the illustrated arrangement and actuate the intake and exhaust valves, respectively, when rotate. The intake camshaft extends generally horizontally over the intake valves from fore to aft parallel to the center plane, while the exhaust camshaft extends generally horizontally over the exhaust valves from fore to aft also parallel to the center plane. Both the intake and exhaust camshafts are journaled for rotation by the cylinder head member 108 with a plurality of camshaft caps, which are affixed to the cylinder head member 108. A cylinder head cover member 158 extends over the camshafts and the camshaft caps, and is affixed to the cylinder head member 108 to define a camshaft chamber.

The intake and exhaust camshafts have cam lobes associated with the intake and exhaust valves, respectively. The intake and exhaust valves normally close the intake and exhaust ports under biasing forces provided by valve springs. When the intake and exhaust camshafts rotate, the respective cam lobes push the associated valves to open the respective ports against the biasing force of the springs. The air thus can generally enter the combustion chambers 110 when the intake valves open and the exhaust gases can generally exit the combustion chambers 110 when the exhaust valves open.

The crankshaft 84 preferably drives the intake and exhaust camshafts. Preferably, the respective camshafts have driven sprockets affixed to ends thereof. The crankshaft 84 also has a drive sprocket. Each driven sprocket has a diameter that is twice as large as a diameter of the drive sprocket. A timing chain or belt is wound around the drive and driven sprockets. When the crankshaft 84 rotates, the drive sprocket drives the driven sprockets via the timing chain, and then the intake and exhaust camshafts also rotate. The rotational speed of the camshafts are reduced to half of the rotational speed of the crankshaft 84 because of the differences in diameters of the drive and driven sprockets.

With reference to FIG. 2, the engine 32 preferably comprises a lubrication system that delivers lubricant oil to engine portions for inhibiting frictional wear of such portions. In the illustrated embodiment, a closed-loop type, dry-sump lubrication system is employed. Lubricant (e.g., oil) for the lubrication system preferably is stored in a lubricant reservoir. The lubrication system includes at least one feed pump that preferably is driven by the crankshaft 84 in the circulation loop to pump the lubricant in the lubricant reservoir to the engine portions that need lubrication.

The engine portions that need lubrication include, for example, but without limitation, the crankshaft bearing sections 118, connecting rod bearing sections and slide surfaces of the pistons 106. The lubrication system has a lubricant delivery mechanism in the engine body 124 and engine components. For instance, the crankshaft 84 and the bearing sections 118 define lubricant galleries 162. The lubricant thus is conveyed or is injected to the crankshaft bearing sections 118, connecting rods bearing sections and the pistons 106 through the lubricant galleries.

The lubricant that has lubricated the engine portions falls to a bottom of the crankcase chamber 116 by its own weight and temporarily stays there. The lubrication system has at least one scavenge pump to return the lubricant to the lubricant reservoir. Due to relatively high speed rotation of the crankshaft 84, the lubricant in the crankcase chamber 116, which is not scavenged and stays therein, is churned and thus likely stays within the crankcase chamber 116 as lubricant mist. In addition, blow-by gases also can accumulate within the crankcase chamber 116. The blow-by gases include unburned fuel and exhaust gases that leak from the combustion chambers 110 through narrow spaces between the cylinder block 102 and the pistons 106 (and more particularly the piston rings) under extremely high pressure in the combustion chambers 110. The lubricant, the lubricant mist and the blow-by gases are viscoidal fluids (somewhat viscous fluids) that can adhere to the engine components or inner walls of the engine body 124. Accordingly, as used herein, "viscoidal fluid" can include lubricant, lubricant mist and/or blow-by gases that can adhere to a surface of the engine body or to a surface of an auxiliary device of the engine (e.g., the flywheel assembly).

The watercraft 30 preferably employs a water cooling system for the engine 32 and the exhaust system. Preferably, the cooling system is an open-loop type and includes a water pump and a plurality of water jackets and/or conduits. In the illustrated arrangement, the jet pump assembly 68 is used as the water pump with a portion of the water pressurized by the impeller being drawn off for the cooling system, as known in the art. At least the engine body 124 and some of the exhaust components 148, 150 define appropriate water jackets therein. The cooling water taken into the cooling system flows through the water jackets to remove heat from the engine body 124 and the exhaust components 148, 150, and then at least a portion of the cooling water is discharged to the external location together with the exhaust gases.

Figure 3:
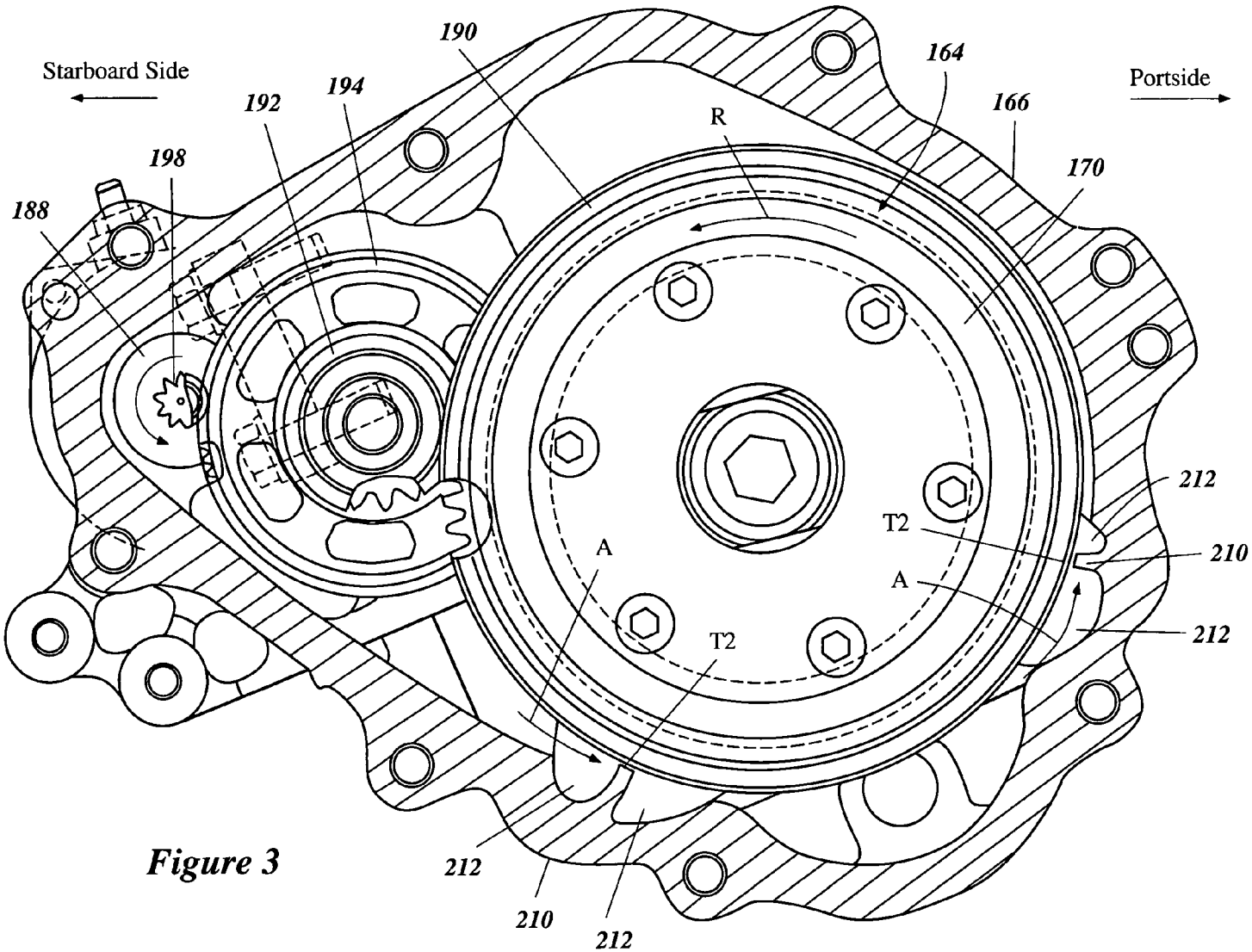
FIG. 3 is a cross-sectional view of a cover member affixed to the engine, taken along the line 3—3 of FIG. 2. Ribs on the cover member and positions thereof are schematically illustrated in this figure. The figure also schematically illustrates the interengagement between a starter motor, a gear train and a crankshaft of the engine; however, the orientation of the gear train and starter motor have been rotated about the crankshaft to lie to the side of the crankshaft to better illustrate the interconnection between these components. The actual position of the starter motor and gear train on the engine is best seen in FIG. 2.

With reference to FIGS. 2 and 3, the illustrated engine 32 also incorporates auxiliary devices as components that relate to the engine operations. The auxiliary devices preferably include a flywheel assembly. The illustrated flywheel assembly forms a flywheel magneto or AC generator 164. The flywheel magneto 164 generates electric power that is necessary for electrical components of the engine 32 such as, for example, the ECU and the ignition system, and also for electrical accessories of the watercraft 30.

In the illustrated embodiment, the flywheel magneto 164 is disposed at the forward end 126 of the crankshaft 84 and within a cover member or enclosure member 166. The cover member 166 preferably is affixed to the engine body 124 to define a space 168 together with the engine body 124. In the illustrated arrangement, the cover member 166 is affixed to the crankcase member 114. The flywheel magneto 164 is enclosed within the space 168.

The forward-most bearing section 118 defines openings 169 around the end portion 126 of the crankshaft 84 that extends through the bearing section 118. Lubricant at the bottom of the crankcase chamber 116 can move into the space 168 through some of the openings 169. Under a normal running condition of the engine 32, the majority of the lubricant at the bottom of the crankcase chamber 116 can be lubricant mist as described above. The lubricant mist and the blow-by gases can also move into the space 168 through any one of the openings 169.

The flywheel magneto 164 comprises a rotor assembly and a stator assembly. The rotor assembly comprises a rotor 170, which preferably has a cup-like shape. The rotor 170 is affixed to the crankshaft 84 by a bolt 172 to rotate with the crankshaft 84. The rotor 170 carries a plurality of magnets 174 affixed to an inner surface of the rotor 170. An outer surface of the rotor 170 is spaced apart from an inner surface of the cover member 166 by a distance T1. The stator assembly comprises a plurality of yokes 176 and coils 178. The stator assembly is mounted on an inner surface of the cover member 160. A plurality of stays 180 extends from the inner surface of the cover member 160 and the yokes 176 are affixed to the stays 180 by bolts 182. Each yoke 178 carries each coil 178, which is wound around the yoke 178, and is able to face the magnets 174 with a gap disposed between the magnets and the coils.

Additionally, a crankshaft rotation sensor or engine speed sensor can be provided next to the stator assembly on the inner surface of the cover member 160 to sense a rotational speed of the crankshaft 84. The sensed signal can be used by the ECU, for example.

With the rotation of the rotor 170, the magnets 174 repeatedly approach and pass over the yokes 174. The magnets 174 thus induce electrical current in the coils 178 by the electromagnetic effect. In other words, the flywheel magneto 164 generates AC power. This AC power can be rectified to DC power and regulated by a rectifier-regulator. The electric power is used by the ECU and other electrical components via a battery or, in some arrangements, directly without the battery.

In another aspect, of course, the flywheel magneto 164 acts as a flywheel that stabilizes the rotation of the crankshaft 84.

In the illustrated arrangement, a starter motor 188 is coupled with the crankshaft 84 through a gear train. The starter motor 188 is disposed generally on the starboard side of the engine body 124. The gear train comprises a first gear 190, a second gear 192 and a third gear 194. The first gear 190 is mounted on the crankshaft 84 for rotation with the crankshaft 84 through, for example, a splined connection. The first gear 190 preferably is interposed between the forward-most bearing section 118 and the flywheel magneto 164; however, in some variations, the first gear can be integrally formed with the flywheel. The second and third gears 192, 194 are coaxially disposed on a shaft or sleeve 196 that is positioned between the crankcase member 114 and the cover member 166. One end of the sleeve 196 is supported by the crankcase member 114 and the other end thereof is supported by the cover member 166. The second gear 192 has a diameter less than a diameter of the third gear 194 and meshes with the first gear 190. The third gear 194 meshes with a pinion shaft 198 of the stator motor 188.

When the rider turns on a starter switch, which can be provided at the handlebar 52, for example, the shaft 198 of the starter motor 188 rotates because the electric power is supplied to the starter motor 188 from the battery. The rotation of the starter motor 188 drives the crankshaft 84 through the gear train at a reduced speed and with an increased torque because of the difference in the diameters of the second and third gears 192, 194. The engine 32 starts operating on its own accordingly. Because the starter motor 188 includes a one-way clutch mechanism, the rotation of the crankshaft 84 does not back drive the starter motor 188 in order to prevent damage to the stator motor 188.

Figure 4:
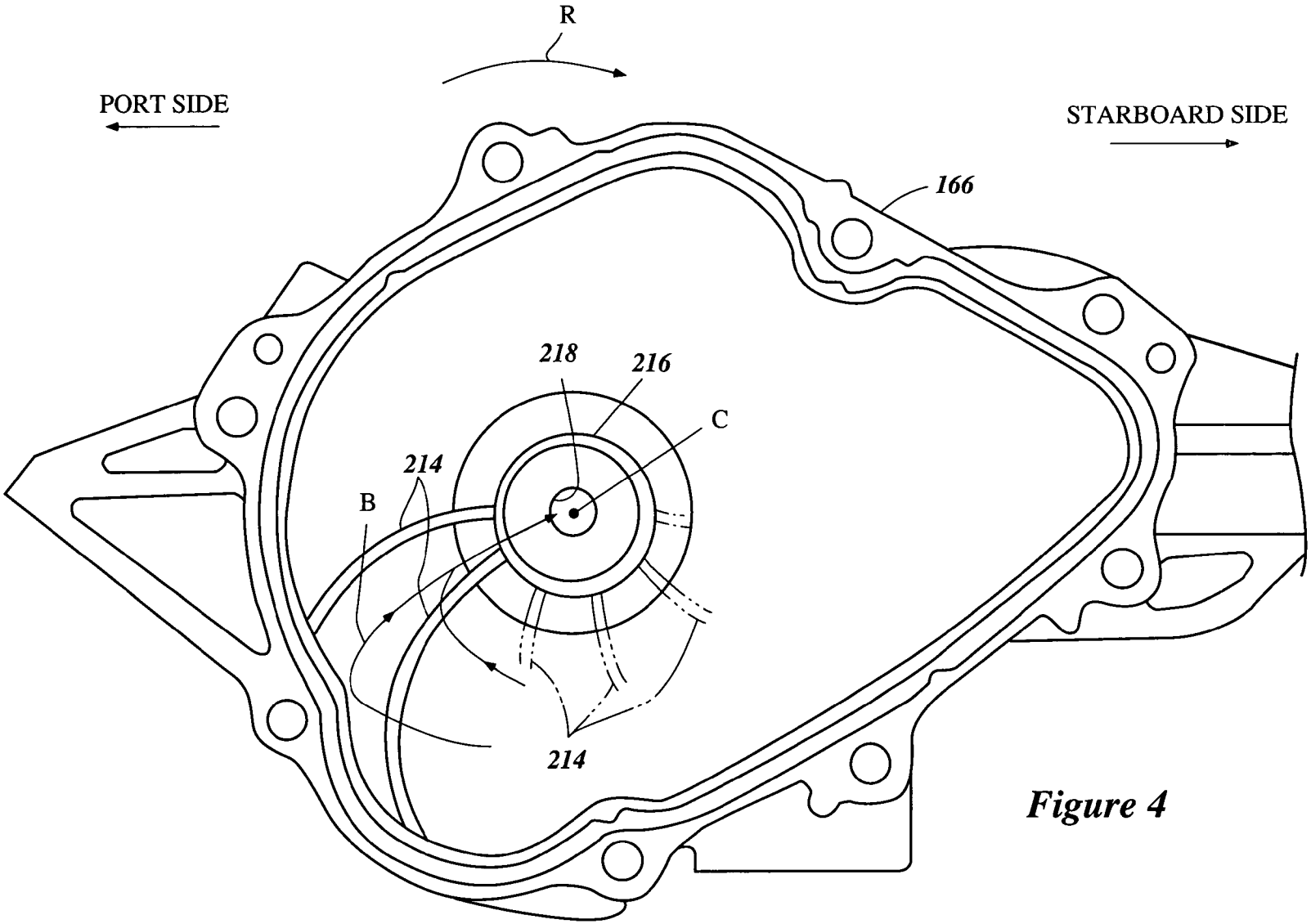
FIG. 4 is a rear view of the cover member taken along the line 4—4 of FIG. 2.

With continued reference to FIGS. 2 and 3 and with additional reference to FIG. 4, the lubricant mist and the blow-by gases can adhere onto the flywheel magneto 164. The lubricant at a bottom of the space 168 also can adhere to the flywheel magneto 164 when the engine 32 does not operate or operates at idle speed. Thus, the cover member 166 in this arrangement defines one or more first ribs or projections 210 that extend from the outer surface of the rotor 170 toward the inner surface of the cover member 166 as best shown in FIG. 3.

In the illustrated arrangement, two ribs 210 are provided. Each rib 210 is spaced apart from the inner surface of the cover member 166 by a distance T2, which is less than the distance T1 between the outer surface of the rotor 170 and the inner surface of the cover member 166. Grooves 212 are formed on both sides of the ribs 210. In other words, two grooves 212 interpose each projection 210 therebetween. The grooves 212 preferably are connected with two of the openings 169 such that the lubricant in the grooves 212 can move to the crankcase chamber 166 through the grooves 212 and the openings 169. The ribs 210 preferably extend along a rotating axis of the flywheel magneto 164, i.e., the axis of the crankshaft 84. The length of each rib 210 in the axial direction preferably is equal to or greater than a length of the outer surface of the rotor 170 in the axial direction. The flywheel magneto 164 rotates in a direction R as indicated in FIG. 3.

In addition to the first ribs 210, the cover member 166 preferably defines a plurality of second ribs 214 on the front inner surface of the cover member 166 as best shown in FIG. 4. Although FIG. 4 illustrates only two ribs 214, a larger number of ribs 214 can be provided, as illustrated in phantom. Preferably, the ribs 214 extend generally radially from a point C, which corresponds to an extended axis of the crankshaft 84, and about point C at equal intervals. Each rib 214 preferably forms an arcuate curve that extends from the inner surface toward the point C. The arcuate curve is configured as shown in FIG. 4, bearing in mind that the flywheel magneto 164 rotates in the direction R. A circular embankment or ridge 216 is formed to surround the point C. The embankment 216 has a height lower than the ribs 214.

The cover member 166 preferably has a pocket or lubricant collecting recess therein. That is, the cover member 166 has double walls at least in part and the pocket is defined between the double walls. The pocket communicates with the space 168 through at least one opening 218 that is defined generally at the point C so as to be surrounded by the embankment 216; however, in other variations, the opening (s) can be located at other locations on the cover member 166. The scavenge pump or another pump of the lubrication system communicates with the pocket. The pump thus suctions the lubricant in the pocket and returns the lubricant to the lubricant reservoir or to another location within the lubrication system or the engine.

When the flywheel magneto 164 rotates in the direction R, the lubricant adhered on the flywheel magneto 164 follows the flywheel magneto 164 as indicated by the arrow A of FIG. 3. The lubricant is removed from the surface of the flywheel magneto (e.g., scraped or wiped off the flywheel surface, but preferably without contacting the flywheel surface) by the first ribs 210 and enters either one of the grooves 212. The lubricant then moves toward the crankcase chamber 116 through the grooves 212 and the openings 162. In the meantime, lubricant, which adheres to the front surface of flywheel magneto 164, removed (e.g., scraped or wiped off without contact) and can be guided by the second ribs 214 toward the opening 218 as indicated by the arrow B of FIG. 4. The removed lubricant enters the pocket through the opening 218. The scavenge pump or another pump then returns the lubricant to the lubricant reservoir or to another location within the lubrication system or the engine.

The second ribs 214 and the embankment 216 also reinforce the cover member 166.

All the second ribs 214 preferably have the same height as others. In one variation, the height of the ribs 214 alternate (e.g., higher, lower, higher, lower, etc.).

Figure 5:
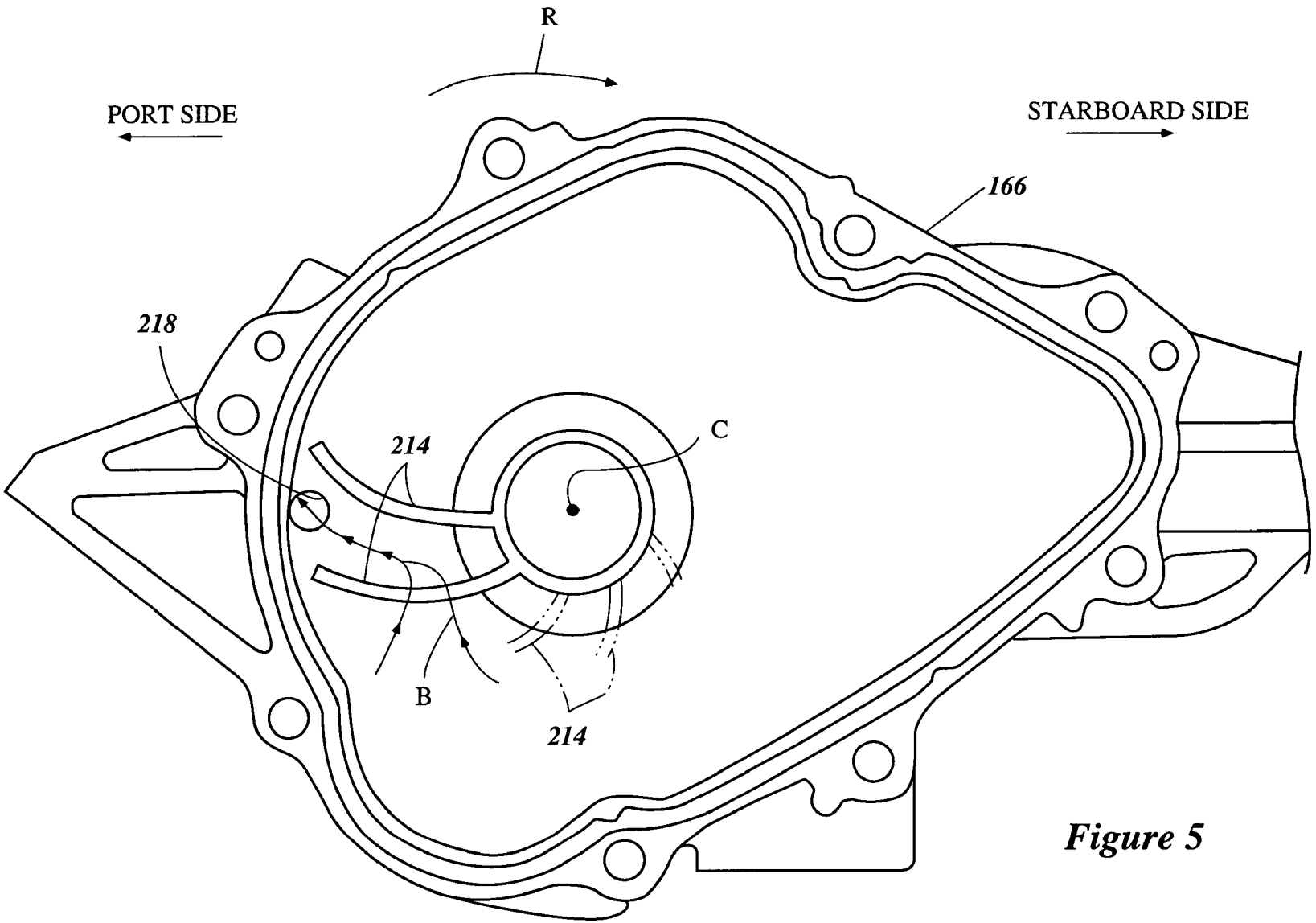
FIG. 5 is a rear view of another cover member showing a modified arrangement.

With reference to FIG. 5, a modified arrangement of the ribs 214 and the opening 218 is illustrated. The arcuate curve of the ribs 214 in this arrangement is different from the arcuate curve of the ribs in the arrangement shown in FIG. 4 because the opening 218 is positioned at a peripheral portion of the cover member 166. Again, variations of the cover can include opening into the pocket.

As thus described, in the illustrated arrangement, the lubricant can be efficiently removed from the flywheel magneto by either the first or second ribs. In some variations of the cover, the second ribs can be omitted if the first ribs are provided. Similarly, the first ribs can be omitted if the second ribs are provided. Moreover, the cover can include only one first rib or one second rib.

The flywheel magneto can be coupled to another rotational member and can be disposed at other locations on the engine. For instance, either the intake or exhaust camshaft can be the rotational member. Moreover, the present fluid removing arrangement can be used with other rotational members and auxiliary devices such as, for example, but without limitation, a compressor driven by the engine.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the present engine has been described in the context of particularly preferred embodiments, the skilled artisan will appreciate, in view of the present disclosure, that certain advantages, features and aspects of the engine may be realized in a variety of other applications, many of which have been noted above. Additionally, it is contemplated that various aspects and features of the invention described can be practiced separately, combined together, or substituted for one another, and that a variety of combination and subcombinations of the features and aspects can be made and still fall within the scope of the invention. Thus, it is intended that the scope of the present invention herein disclosed should not be limited by the particular disclosed embodiments described above, but should be determined only by a fair reading of the claims that follow.

What is claimed is:

1. An internal combustion engine comprising an engine body, a rotatable member rotating relative to the engine, an auxiliary device coupled to the rotatable member so as to rotate with the rotatable member, and an enclosure member at least partially covering the auxiliary device, the auxiliary device being enclosed within a space that is defined at least in part by the enclosure member, the space containing viscoidal fluid that generally adheres onto the auxiliary device, the enclosure member having at least one projection extending toward the auxiliary device, the projection being spaced closely to the auxiliary device so as to remove at least a portion of the viscoidal fluid adhered on the auxiliary device when the auxiliary device rotates.

2. The engine as set forth in claim 1, wherein the enclosure member is coupled with the engine body and defines the space together with the engine body.

3. The engine as set forth in claim 1, wherein the projection is unitarily formed with at least another portion of the cover member.

4. The engine as set forth in claim 1, wherein the auxiliary device defines an outer surface, the enclosure member defines an inner surface, and the projection is formed on the inner surface and extends generally parallel to the outer surface.

5. The engine as set forth in claim 4, wherein the outer surface is spaced apart from the projection.

6. The engine as set forth in claim 4, wherein the projection includes a rib formed on the inner surface.

7. The engine as set forth in claim 4, wherein the projection generally axially extends along a rotating axis of the auxiliary device.

8. The engine as set forth in claim 7, wherein a length of the projection in the axial direction is generally equal to or greater than a length of the outer surface in the axial direction.

9. The engine as set forth in claim 1, wherein the enclosure member additionally has a second projection extending toward the auxiliary device, and a fluid collecting recess generally formed on an inner surface of the enclosure member, the second projection removes viscoidal fluid adhered on the auxiliary device and guides the viscoidal fluid toward the fluid collecting recess when the auxiliary device rotates.

10. The engine as set forth in claim 1, wherein the viscoidal fluid includes a liquid lubricant.

11. The engine as set forth in claim 1, wherein the rotatable member is a crankshaft.

12. An internal combustion engine comprising an engine body, a rotatable member rotating relative to the engine, an auxiliary device coupled to the rotatable member so as to rotate with the rotatable member, and an enclosure member at least partially covering the auxiliary device, the auxiliary device being enclosed within a space that is defined at least in part by the enclosure member, the space containing viscoidal fluid that generally adheres onto the auxiliary device, the enclosure member having at least one projection extending toward the auxiliary device, the projection being spaced closely to the auxiliary device so as to remove at least a portion of the viscoidal fluid adhered on the auxiliary device when the auxiliary device rotates, wherein the auxiliary device includes a flywheel assembly.

13. An internal combustion engine comprising an engine body, a rotatable member rotating relative to the engine body, an auxiliary device coupled to the rotatable member so as to rotate with the rotatable member, and an enclosure member at least partially covering the auxiliary device, the auxiliary device being enclosed within a space that is defined at least in part by the enclosure member, the space containing viscoidal fluid that generally adheres onto the auxiliary device, the enclosure member having at least one projection extending toward the auxiliary device, and a fluid collecting recess generally formed on an inner surface of the enclosure member, the projection removing at least a portion of the viscoidal fluid adhered on the auxiliary device and guiding the viscoidal fluid toward the fluid collecting recess when the auxiliary device rotates.

14. The engine as set forth in claim 13, wherein the fluid collecting recess includes a pocket defined by the enclosure member.

15. An internal combustion engine comprising an engine body, a rotatable member rotating relative to the engine body, an auxiliary device coupled to the rotatable member so as to rotate with the rotatable member, and an enclosure member at least partially coveting the auxiliary device, the auxiliary device being enclosed within a space that is defined at least in part by the enclosure member, the space containing viscoidal fluid that generally adheres onto the auxiliary device, the enclosure member having at least one projection extending toward the auxiliary device, and a fluid collecting recess generally formed on an inner surface of the enclosure member, the projection removing at least a portion of the viscoidal fluid adhered on the auxiliary device and guiding the viscoidal fluid toward the fluid collecting recess when the auxiliary device rotates, additionally comprising a fluid pump configured to suction the viscoidal fluid in the fluid collecting recess.

16. An internal combustion engine comprising an engine body, a rotatable member rotating relative to the engine body, an auxiliary device coupled to the rotatable member so as to rotate with the rotatable member, and an enclosure member at least partially covering the auxiliary device, the auxiliary device being enclosed within a space that is defined at least in part by the enclosure member, the space containing viscoidal fluid that generally adheres onto the auxiliary device, the enclosure member having at least one projection extending toward the auxiliary device, and a fluid collecting recess generally formed on an inner surface of the enclosure member, the projection removing at least a portion of the viscoidal fluid adhered on the auxiliary device and guiding the viscoidal fluid toward the fluid collecting recess when the auxiliary device rotates, wherein the projection has an arcuate curve toward the fluid collecting recess.

17. An internal combustion engine comprising an engine body, a rotatable member rotating relative to the engine body, an auxiliary device coupled to the rotatable member so as to rotate with the rotatable member, and an enclosure member at least partially covering the auxiliary device, the auxiliary device being enclosed within a space that is defined at least in part by the enclosure member, the space containing viscoidal fluid that generally adheres onto the auxiliary device, the enclosure member having at least one projection extending toward the auxiliary device, and a fluid collecting recess generally formed on an inner surface of the enclosure member, the projection removing at least a portion of the viscoidal fluid adhered on the auxiliary device and guiding the viscoidal fluid toward the fluid collecting recess when the auxiliary device rotates, wherein at least a portion of the collecting recess is disposed generally at a location on the enclosure member through which a rotational axis of the rotating member passes.

18. An internal combustion engine comprising an engine body, a crankshaft journaled on the engine body, a flywheel assembly mounted on one end of the crankshaft, the flywheel assembly rotating together with the crankshaft, and an enclosure member coupled with the engine body and defining a space together with the engine body, the flywheel assembly being enclosed within the space, the space containing lubricant or lubricant mist that is capable to adhere onto the flywheel assembly, the enclosure member having a projection extending toward the flywheel assembly, the projection removing lubricant adhered on the flywheel assembly when the flywheel assembly rotates.

19. The engine as set forth in claim 18, wherein the flywheel assembly defines an outer surface, the enclosure member defines an inner surface, and the projection is formed on the inner surface and extends generally parallel to the outer surface.

20. The engine as set forth in claim 18, wherein the enclosure member additionally has a second projection extending toward the flywheel assembly, and an lubricant collecting recess generally formed on an inner surface of the enclosure member, the second projection scratches away the lubricant adhered on the flywheel assembly and guides the lubricant toward the lubricant collecting recess when the flywheel assembly rotates.

21. The engine as set forth in claim 18, wherein the crankshaft extends generally horizontally, and the enclosure member is disposed on a side of the engine body.

22. A watercraft comprising a hull, a propulsion device propelling the hull, and an engine powering the propulsion device, the engine comprising an engine body, a crankshaft journaled on the engine body, an auxiliary device coupled to the crankshaft so as to rotate with the crankshaft, and an enclosure member at least partially covering the auxiliary device, the auxiliary device being enclosed within a space that is defined at least in part by the enclosure member, the space containing viscoidal fluid that generally adheres onto the auxiliary device, the enclosure member having at least one projection extending toward the auxiliary device, the projection being spaced closely to the auxiliary device so as to remove at least a portion of the viscoidal fluid adhered on the auxiliary device when the auxiliary device rotates.

23. The watercraft as set forth in claim 22, wherein the crankshaft extends generally horizontally when the hull floats in a normal upright position.

24. The watercraft as set forth in claim 23, wherein the enclosure member is disposed on a side of the engine body.

25. The watercraft as set forth in claim 24, wherein the side is a front side of the engine.

26. The watercraft as set forth in claim 22, wherein the crankshaft extends generally fore to aft relative to the hull.

27. The watercraft as set forth in claim 26, wherein the enclosure member is disposed on a side of the engine body.

28. The watercraft as set forth in claim 27, wherein the side is a front side of the engine.

29. The watercraft as set forth in claim 26, wherein the propulsion device is disposed generally at a rear end of the hull, the crankshaft drives the propulsion device through at least an intermediate shaft, the intermediate shaft being disposed on a rear side of the engine body, and the auxiliary device is disposed on a side of the engine that is opposite to the side on which the intermediate shaft is disposed.

30. A watercraft comprising a hull, a propulsion device propelling the hull, and an engine powering the propulsion device, the engine comprising an engine body, a crankshaft journaled on the engine body, an auxiliary device coupled to the crankshaft so as to rotate together with the crankshaft, an enclosure member at least partially covering the auxiliary device, the auxiliary device being enclosed within a space that is defined at least in part by the enclosure member, the space containing viscoidal fluid that generally adheres onto the auxiliary device, the enclosure member having at least one projection extending toward the auxiliary device, the enclosure member generally forming a fluid collecting recess on an inner surface of the enclosure member, the projection arranged to remove at least a portion of the viscoidal fluid adhered onto the auxiliary device and guiding the viscoidal fluid toward the fluid collecting recess when the auxiliary device rotates.

31. The watercraft as set forth in claim 30, wherein the crankshaft extends generally horizontally.

* * * * *

UNITED STATES PATENT AND TRADEMARK OFFICE

CERTIFICATE OF CORRECTION

PATENT NO. : 7,137,376 B2
APPLICATION NO. : 10/341188
DATED : November 21, 2006
INVENTOR(S) : Kazumasa Ito It is certified that error appears in the above-identified patent and that said Letters Patent is hereby corrected as shown below:

Column 1, line 7, after "Application" delete "No" and insert -- No. --, therefor.

Column 12, line 63, in claim 15, delete "coveting" and insert -- covering --, therefor.

Signed and Sealed this

Fourth Day of December, 2007

JON W. DUDAS
*Director of the United States Patent and Trademark Office*